US009314756B2

(12) United States Patent
Campbell et al.

(10) Patent No.: US 9,314,756 B2
(45) Date of Patent: Apr. 19, 2016

(54) PLASTIC CONTAINER WITH INTERNAL MIXING RIBS

(71) Applicant: KW CONTAINER, Troy, AL (US)

(72) Inventors: N Kenneth Campbell, Troy, AL (US); Darren Scholl, Troy, AL (US); David Bacon, Troy, AL (US); Keith Rukvina, Dothan, AL (US)

(73) Assignee: KW Container, Troy, AL (US)

( * ) Notice: Subject to any disclaimer, the term of this patent is extended or adjusted under 35 U.S.C. 154(b) by 0 days.

(21) Appl. No.: 14/563,775

(22) Filed: Dec. 8, 2014

(65) Prior Publication Data

US 2015/0265982 A1 Sep. 24, 2015

Related U.S. Application Data

(60) Provisional application No. 61/955,034, filed on Mar. 18, 2014, provisional application No. 62/057,021, filed on Sep. 29, 2014.

(51) Int. Cl.
*B01F 9/00* (2006.01)
*B01F 15/00* (2006.01)

(52) U.S. Cl.
CPC ..... *B01F 15/00896* (2013.01); *B01F 2215/005* (2013.01); *B01F 2215/0422* (2013.01); *B01F 2215/0427* (2013.01); *B01F 2215/0431* (2013.01)

(58) Field of Classification Search
CPC ..... B01F 9/0034
USPC ..... 366/57, 59, 130, 306, 307, 228, 605
See application file for complete search history.

(56) References Cited

U.S. PATENT DOCUMENTS

| | | | | | |
|---|---|---|---|---|---|
| 1,134,354 | A | * | 4/1915 | SeifKE | 215/382 |
| 1,713,979 | A | * | 5/1929 | Redmond | 68/213 |
| 3,088,715 | A | * | 5/1963 | Deindoerfer | 366/108 |
| 3,175,808 | A | | 3/1965 | Dedoes | |
| 3,738,760 | A | | 6/1973 | Madeira | |
| 4,078,263 | A | | 3/1978 | Campbell | |
| 4,253,772 | A | | 3/1981 | Burton-Smith | |
| 4,521,116 | A | * | 6/1985 | Adsit | 366/54 |
| 4,875,781 | A | | 10/1989 | Raska | |
| 4,880,312 | A | | 11/1989 | Carlson | |
| 5,094,543 | A | | 3/1992 | Mursa | |
| 5,320,248 | A | | 6/1994 | Jamieson, III | |
| 5,403,086 | A | * | 4/1995 | Lindesay | 366/59 |
| 5,651,613 | A | | 7/1997 | Mays et al. | |
| 5,676,462 | A | | 10/1997 | Fraczek et al. | |
| 5,676,463 | A | | 10/1997 | Larsen | |
| 8,746,958 | B2 | | 6/2014 | Spray | |
| 2002/0098268 | A1 | | 7/2002 | Cohen et al. | |
| 2005/0007875 | A1 | | 1/2005 | Reinemuth | |
| 2006/0187746 | A1 | | 8/2006 | Ogg | |
| 2007/0081419 | A1 | | 4/2007 | Mou | |
| 2009/0314666 | A1 | | 12/2009 | Reif et al. | |
| 2013/0163370 | A1 | | 6/2013 | Shaifer et al. | |
| 2013/0182526 | A1 | | 7/2013 | Dertina, Sr. | |
| 2014/0043931 | A1 | * | 2/2014 | Figueroa | 366/130 |

* cited by examiner

*Primary Examiner* — David Sorkin
(74) *Attorney, Agent, or Firm* — Joseph S. Bird, III; Bradley Arant Boult Cummings LLP

(57) ABSTRACT

A paint container with internal mixing ribs.

21 Claims, 6 Drawing Sheets

PLASTIC CONTAINER WITH INTERNAL MIXING RIBS

STATEMENT CONCERNING PRIORITY

This application claims the benefit of, and priority to, U.S. provisional patent application No. 61/955,034 filed on Mar. 18, 2014 entitled "Plastic Paint Can with Internal Mixing Ribs". This application also claims the benefit of, and priority to, U.S. provisional patent application No. 62/057,021 filed on Sep. 29, 2014, bearing the same title.

TECHNICAL FIELD

The field of invention is injection plastic molded containers including, without limitation, containers for paint and coatings.

DEFINITIONS

The following definitions apply throughout:

"Innermost" means closest to the center of the container.

"Paint" includes paint, coatings, tints and any other related or similar liquids.

"Radial" refers to a mixing rib occupying a portion of a radius nearest the cylindrical sidewall which could be drawn from the center of a cylinder to a point on the interior of the cylindrical sidewall. A radial rib is perpendicular (at 90 degrees) to a tangent passing through a point on the cylinder's sidewall.

"Near-radial" refers to a mixing rib joined to the cylinder sidewall at a slight angle to a tangent passing through a point on the cylinder's sidewall, within a range of at least 70 degrees and less than 90 degrees.

BACKGROUND ART

Paint is normally sold in cylindrical containers which originally were made of metal. Metal paint containers had the limitations, though, of corroding and sustaining dents which could not be removed. More recently, the growth of injection plastic molding has made plastic containers a more desirable solution than metal.

Paint is typically mixed or blended in a machine which either spins the container or inserts an impeller and agitates the fluid directly. Mixing machines create a simple vortex in the center of the container, but the simple vortex is not sufficient for mixing today's paint which requires more random and chaotic fluid dynamics.

The paint industry has experienced changes recently in paint formulation, primarily driven by government regulations requiring removal of solvents. The removal or reduction of solvents has made mixing paint more difficult and time-consuming in stores; the current paint container with a smooth interior wall having mixing ribs does not provide enough agitation to mix paint effectively in a machine mixer without requiring additional time from store personnel. That is, reducing the time of store personnel in mixing paint with a machine at the time of purchase would have a large impact on the efficiency of these store personnel.

Although internal structures in a container to improve mixing of liquids within the container have been known in the art, they have not been common in the paint container industry because they were unnecessary prior to government regulatory changes. Until fairly recently most paint containers were metal. Mass production of mixing ribs in a metal container requires attachment with mechanical means such as rivets, screws and nuts, and can be costly and impractical, Mixing ribs larger than those in the present invention have a greater tendency to create areas within the container which interfere with usage by consumers with implements such as paint brushes and stirrers. Larger mixing ribs can also prevent the liquid from being mixed sufficiently. The larger the mixing ribs, the more likely they will inhibit mixing by the spinning-type or impeller-type machine, producing an unevenly mixed fluid. Mixing ribs which extend toward the center of the container further than the inner circumference or border of the rim are contrary to the invention herein. An alternative way of stating this is that prior art mixing ribs often extend toward the center of the container a greater distance than does the inner rim border.

The position of the mixing ribs is also important. A mixing rib in prior art can be of many shapes including helical, pyramidal, or planar. Mixing ribs which are not radial or near-radial to the interior cylindrical wall (as specifically defined herein) and the bottom do not create as much agitation as does a radial or near-radial structure of the same height measured from the interior wall to the innermost tip of the mixing ribs. For purposes of delivering a container to the paint industry which is economically feasible, the less plastic used in a container the better, so a smaller structure is highly desirable. A helical mixing rib, for example, in a cylindrical container with a smooth exterior wall requires more plastic material than a radial or near-radial mixing rib of the same height from the interior wall.

Contours which cover substantially all of the internal walls (as opposed to the smooth internal wall with intermittent radial or near-radial mixing ribs of the invention herein) are too complicated to make or require too much raw material to be economically feasible in the mass market.

Therefore, missing from the prior art is the optimal mixing rib configuration (e.g., shape, size, location and quantity) to maximize even mixing, reduce raw material requirements in production and provide easy access with a paint brush for a user. The prior art does not provide an adequate solution for mass production of a plastic container producing sufficient mixing of paint. Given the foregoing design constraints, it is therefore desirable to employ a different design for an injection molded plastic container which will decrease the cost, increase the potential for mixing paint or other liquids, and also be highly practical for a user.

DETAILED DESCRIPTION

Figure 1:
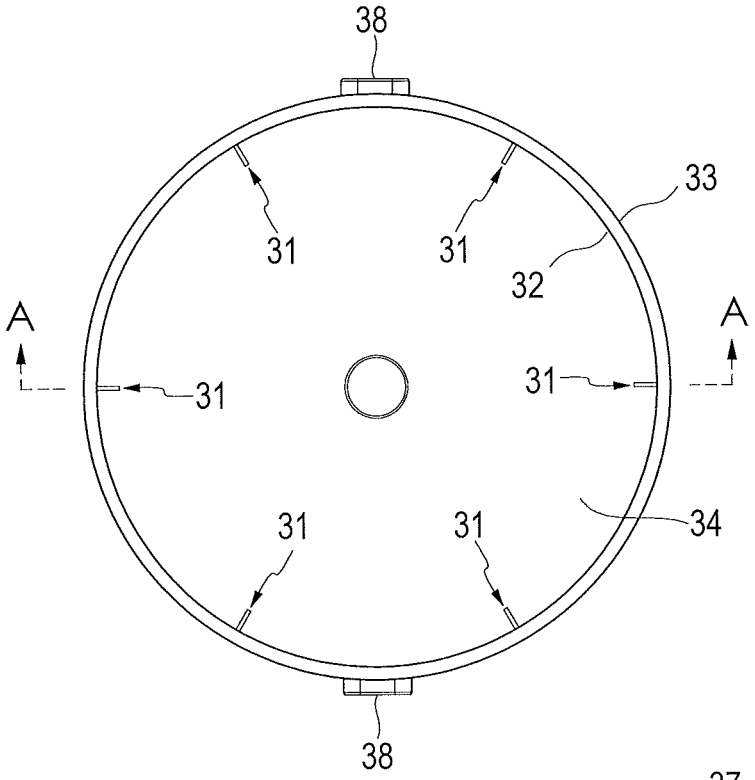
FIG. 1 is a top plan view of the cylinder sidewall and bottom of the container showing six (6) radial mixing ribs spaced evenly along the interior wall of the paint container cylinder, and denoting section A-A. In this Figure the ears for securing the handle on the exterior of the container are rotated from the position in FIG. 3. The rim is not attached to the cylinder sidewall at the top of the container, in order to show the position and distribution of the mixing ribs.

The present invention provides a novel plastic container design which solves the mixing problem caused by lack of solvents. The specific dimensions provided are for a one gallon container with an internal cavity approximately seven (7) inches high and an internal diameter of approximately six and one-half (6.5) inches. For containers having different internal diameters, the relationships among the dimensions would be similar though the specific dimensions would vary approximately proportionally. Certain aspects of the container herein are also described in pending U.S. patent application Ser. No. 13/918,391, entitled Plastic Container and Lid, which is incorporated by reference herein in its entirety.

The structures in this invention provide enough agitation to mix paint effectively in a traditional paint mixing machine which spins, rotates or agitates a paint container. The solution provided herein results from a plurality of internal mixing ribs 31 within the container which provide additional agitation as the container rotates in a paint mixer or is mixed by an impeller. A preferred number of mixing ribs is six, but can also be within a range of five to eight, inclusive. The additional agitation provided by the mixing ribs 31 assists in mixing paint, including those formulations from which solvents have been removed entirely or reduced from prior levels. In all embodiments of the present invention the mixing ribs do not extend towards the center of the container farther than the opening at the open end 37 of the container defined by the inner rim border 16. In some embodiments the mixing ribs do not extend as far as the opening at the top of the container defined by the rim 2. An alternative way of describing this aspect of the invention is that the distance from the interior wall 32 to the inner rim border 16 on the rim 2 is equal to or greater than the height from the interior wall 32 to the tips 36 of the mixing ribs 31. In all embodiments the mixing ribs are solid, i.e., they have no holes or apertures.

The present invention is designed specifically as a plastic container formed by injection molding. The container is substantially cylindrical having a sidewall 28 comprising an interior wall 32 and an exterior wall 33, as well as a bottom 34. The container has a center which is a longitudinal axis spanning the length of the cylinder. The cylinder sidewall and bottom are integrally formed together in the injection process. The sidewall 28 is at a right angle or at 90 degrees to the bottom 34 of the container. The rim 2 is affixed to the open end 37 of the cylinder sidewall by adhesive or spin welding.

FIG. 1 is a top plan view of the cylinder sidewall 28 and bottom 34 of the container, according to an embodiment of the present disclosure with mixing ribs 31 which are radial. The rim is not attached to the top of the cylinder sidewall, in order to show the position and distribution of the mixing ribs. The container is substantially cylindrical and contains a plurality of internal mixing ribs 31 integral with its interior wall 32. The design considerations for the mixing ribs in a paint can include the size of the container including the rim, size and configuration of the mixing machines, the size of paint brushes, and the way in which the cans are used. As depicted in FIG. 1, the invention has six (6) radial mixing ribs molded by an injection molding process to be integral with the cylinder sidewall 28, i.e., joining the interior wall 32, to achieve the desired agitation. In a preferred embodiment the ribs may be evenly spaced. The mixing ribs depicted in FIG. 1 are substantially vertical and linear and a set of innermost points the vertical lengths of the mixing ribs comprise mixing rib tips 36. The innermost points along each tip 36 form a line substantially parallel to a corresponding vertical line composed of points on the sidewall 28 where the mixing rib is integrally joined. The innermost points along each tip also form a line substantially parallel with the longitudinal axis in the center of the cylinder. The tips may have any configuration or shape as long as the innermost points along the entire vertical length of the ribs form a line parallel to the longitudinal axis. Each mixing rib has a first side and a second side, both sides being radial or near-radial to the longitudinal axis in the center of the container. The internal mixing ribs are comprised of plastic and are integral to the container created in the plastic molding process, that is, the mixing ribs are molded integrally and are continuous with the interior wall 32 and the bottom 34. The internal mixing ribs extend radially or near-radially from the interior wall 32. A radial mixing rib is perpendicular to a tangent passing through a point on the sidewall 28, and a near-radial rib is positioned at a slight angle, at least 70 but less than 90 degrees, to the said tangent passing through a point on the sidewall. This geometry allows the height of the mixing ribs from the interior wall 32 to be no greater than the distance of the inner rim border 16 from the interior wall 32. That is, a radial or near-radial structure creates more turbulence than a structure of the same height with more gradual slopes, for example, a helical shape as in the background art. The mixing ribs are not convex, concave or curvilinear although they can, in one embodiment, taper or narrow slightly from their base 39 to the tip 36. Each mixing rib has a vertical axis which is parallel to the longitudinal axis in the center, and which is perpendicular to the bottom 34.

The invention balances the need during machine mixing for velocity in a central vortex versus turbulence creating more chaotic movements. This configuration allows the turbulence and eddies created by each mixing rib to affect the turbulence and eddies of the other mixing ribs, so that the desirability of the vortex is balanced against the random and chaotic mixing action of turbulence and eddies. Mixing ribs larger than those specified herein could leave some of the paint not mixed thoroughly. Likewise, mixing ribs which are larger than the invention herein interfere with usage of a paint brush or even a hand held stirrer at a job site. It is therefore desirable that the height of the mixing rib, from its tip 36 to the interior wall 32, be smaller than the prior art but also that the mixing ribs be more numerous than typically in the prior art.

The mixing ribs may be located relative to the ears 38 as depicted in FIG. 1 (and FIG. 3) or the mixing ribs may be rotated in relation to the ears.

Figure 2:
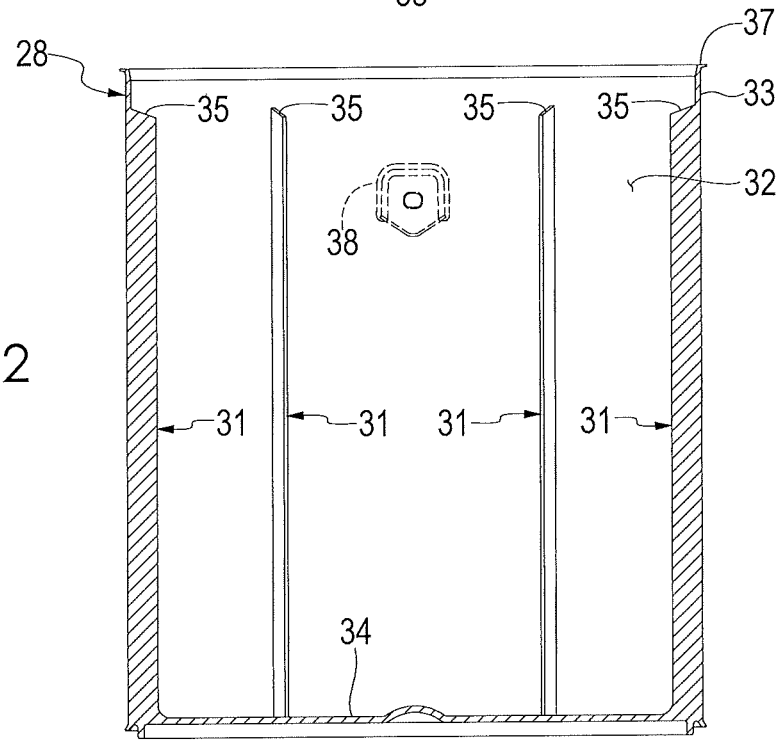
FIG. 2 contains section A-A from FIG. 1.

FIG. 2 is a sectional view taken from the section line A-A depicted in FIG. 1. The internal mixing ribs depicted in FIG. 2 are substantially vertical and, in one embodiment for a one gallon container, comprise a mixing rib top 35 which is angled so that the lowest portion of the mixing rib top is approximately 0.500 inches, or within a range of 0.450-0.550 inches, below the rim 2 of the container. The top 35 however can be of any shape or angle as long as a gap or space remains between the mixing rib and the rim.

Figure 3:
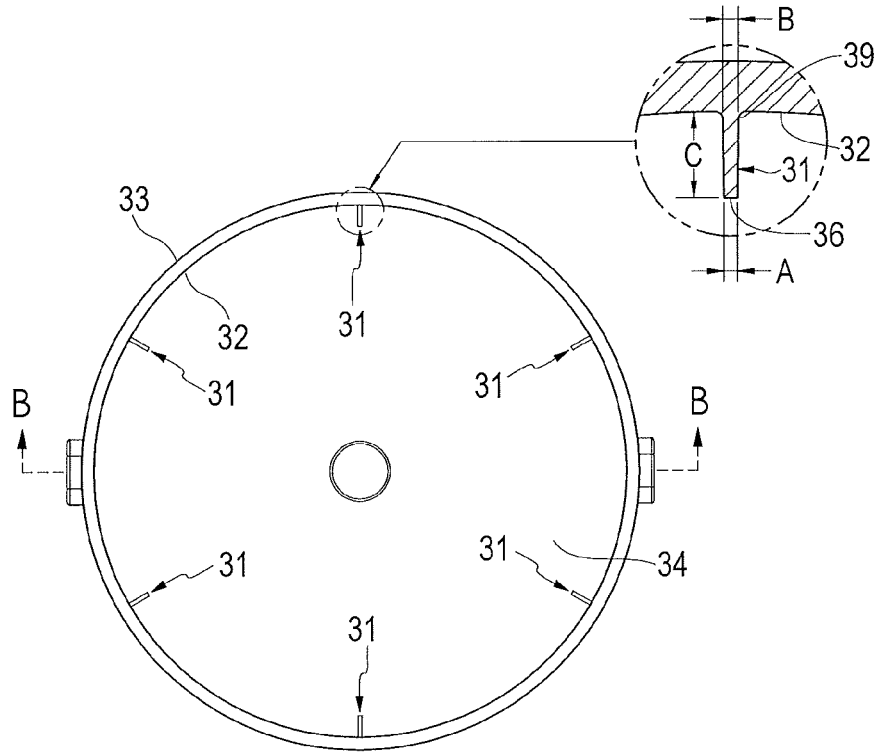
FIG. 3 is a top plan view of the cylinder sidewall and bottom of the container invention transverse to the position in FIG. 1, and denoting section B-B. From this view the ears on the exterior of the container are at the sides of the container. An inset enlargement of a mixing rib provides greater detail. The rim is not attached to the cylinder sidewall at the top end of the container, in order to show the position and distribution of the mixing ribs.

FIG. 3 is a top plan view of the invention transverse to the position in FIG. 1, and denoting section B-B. The sectional view in the inset in FIG. 3 shows greater detail on the mixing ribs' joinder to the interior wall 32. Dimensions A, B and C are defined in the inset. As depicted in this figure, a mixing rib may be a flat, relatively thin structure, as depicted in FIG. 3 and the other figures, but the thickness of the mixing rib may also vary. A preferred thickness for the mixing rib at its tip 36 (i.e., its innermost point nearest the center of the container shown by dimension A) is approximately 0.025 inches from a first side to a second side, or within a range of 0.020-0.030 inches. The first and second sides of the mixing rib are shown by the two arrows associated with dimension A. A preferred thickness from the first side to the second side of the mixing rib where it joins the interior wall 32 is approximately 0.045 inches, or within a range of 0.035-0.055 inches, as shown in dimension B. A mixing rib extends from the interior wall 32 of the container a height of approximately 0.250 inches, or within a range of 0.200-0.400 inches, as shown in dimension C. The dimensions described in this paragraph are appropriate for a one gallon container.

Figure 4:
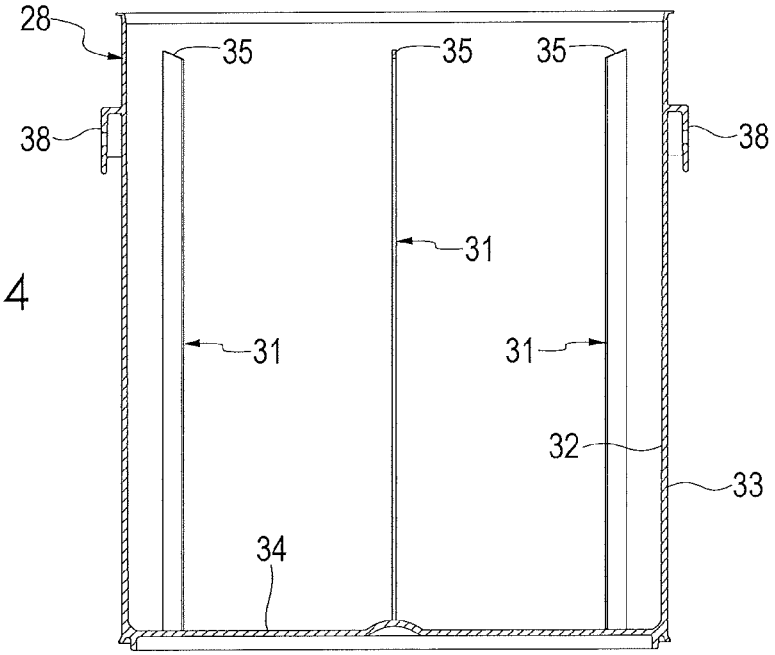
FIG. 4 contains section B-B from FIG. 3.

FIG. 4 is a sectional view taken from the line B-B depicted in FIG. 3.

Figure 5A:
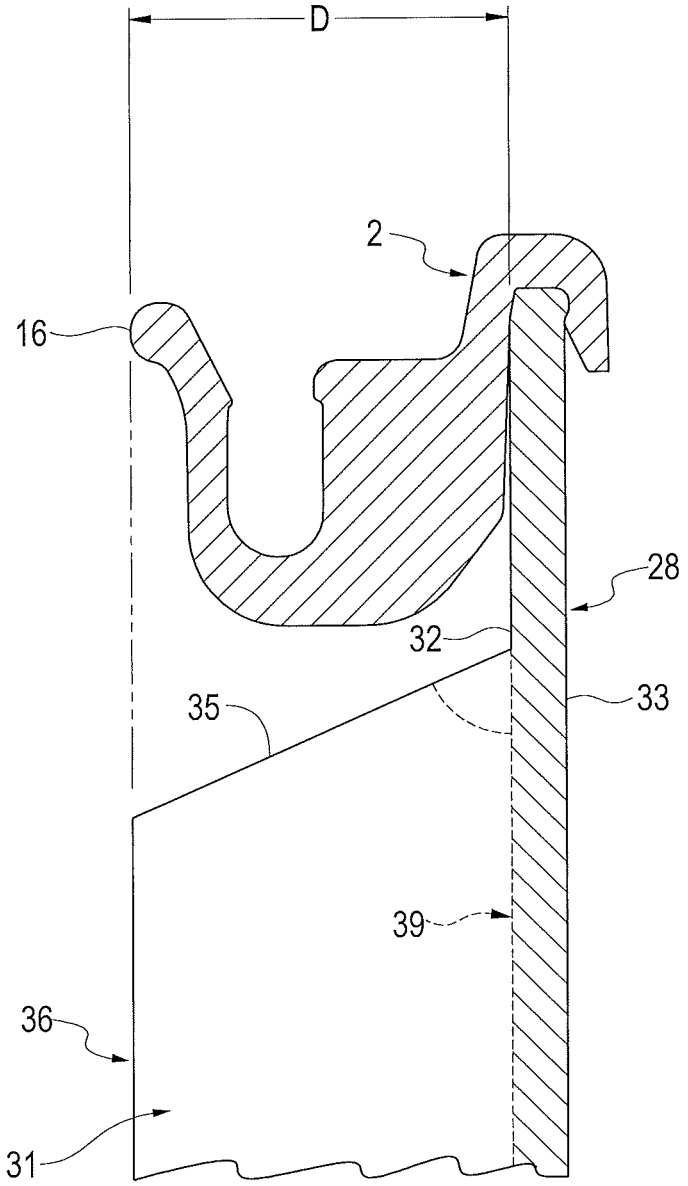
FIG. 5A is a section view showing the relative position between a radial mixing rib and the rim of the paint container, in which the tip of the mixing rib (i.e., the portion nearest the center of the container) is substantially the same height from the interior wall as is the distance from the interior wall to the inner rim border.
Figure 5B:
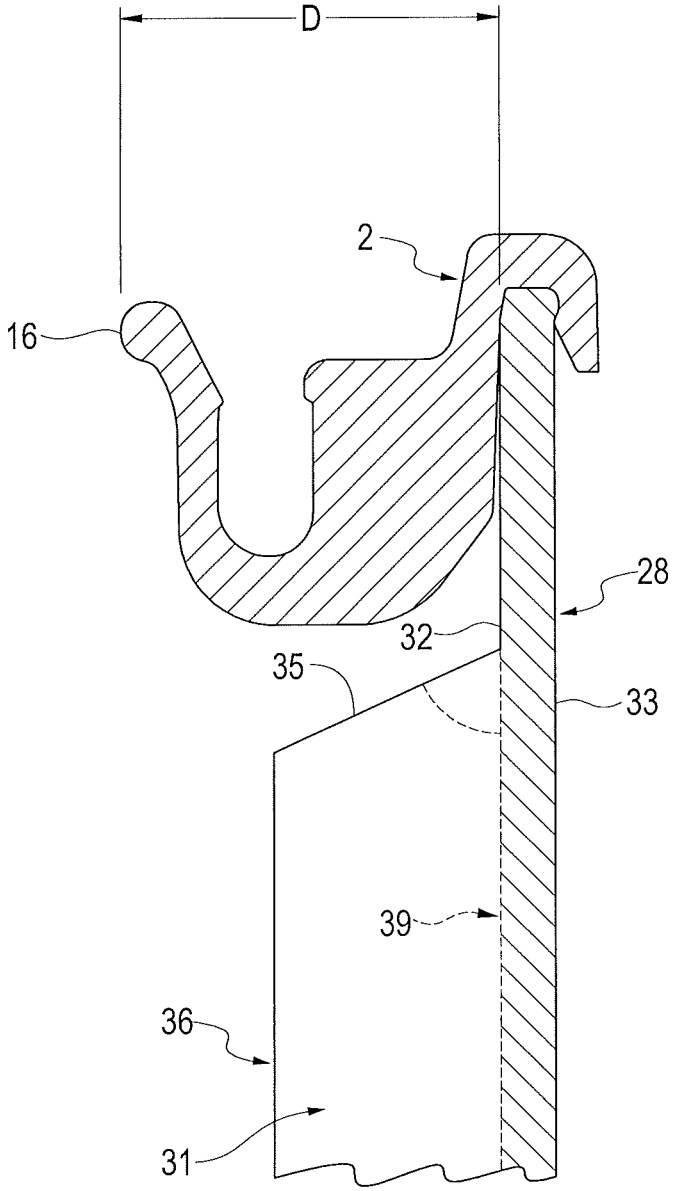
FIG. 5B is a section view showing one embodiment of the relative position between a mixing rib and the rim of the paint container, in which the height of the mixing rib tip from the interior wall is less than the distance from the inner rim border to the interior wall.

FIGS. 5A and 5B are sectional views depicting the junction of the rim 2 with the sidewall 28 of the cylinder. In no embodiment of the invention does the radial or near-radial mixing rib tip 36 extend further toward the center of the container than the inner rim border 16 which, in one embodiment, is the head of the locking tab of the rim. In one embodiment for a one gallon container, the inner rim border 16 is a distance of approximately 0.40 inches, or within a range of 0.030-0.050 inches inclusive, from the interior wall 32 toward the center of the container, as shown by dimension D. In FIG. 5A's embodiment, the mixing rib tips extend inwardly toward the center of the cylinder so that the distance from the interior wall 32 to the inner rim border 16 is substantially the same as the distance from the mixing rib tips 36 to the interior wall 32. FIG. 5A is a sectional view of the rim 2 which is affixed to the top of the cylinder sidewall 28. In another embodiment of the mixing ribs, depicted in FIG. 5B, the distance from the inner rim border 16 to the interior wall 32 exceeds the height of the mixing rib tips 36 from the interior wall 32. All of the mixing ribs are integral and joined to the bottom 34 and rise vertically from the bottom of the container, so that there is no space or gap between a mixing rib and the bottom 34. All of the mixing ribs are also integral to the interior wall 32, so that the base 39 of each mixing rib is integral to the interior wall 32 and there is no portion of a mixing rib which has a space or gap between it and the interior wall 32. In contrast, however, the mixing ribs do not extend vertically to the top of the interior wall 32, as the mixing ribs terminate in close proximity below the rim 2. The mixing ribs extend vertically and continuously from the bottom of the container terminating below the rim so that the mixing rib tops 35 do not contact the rim 2. There is a small space between the ribs and the rim, which contributes to mixing, along with the other features herein. A mixing rib top 35 may have any configuration, and in one embodiment has a 70 degree angle, as depicted by the dotted line arcs at the top of the mixing rib 31 in FIGS. 5A and 5B.

Figure 6:
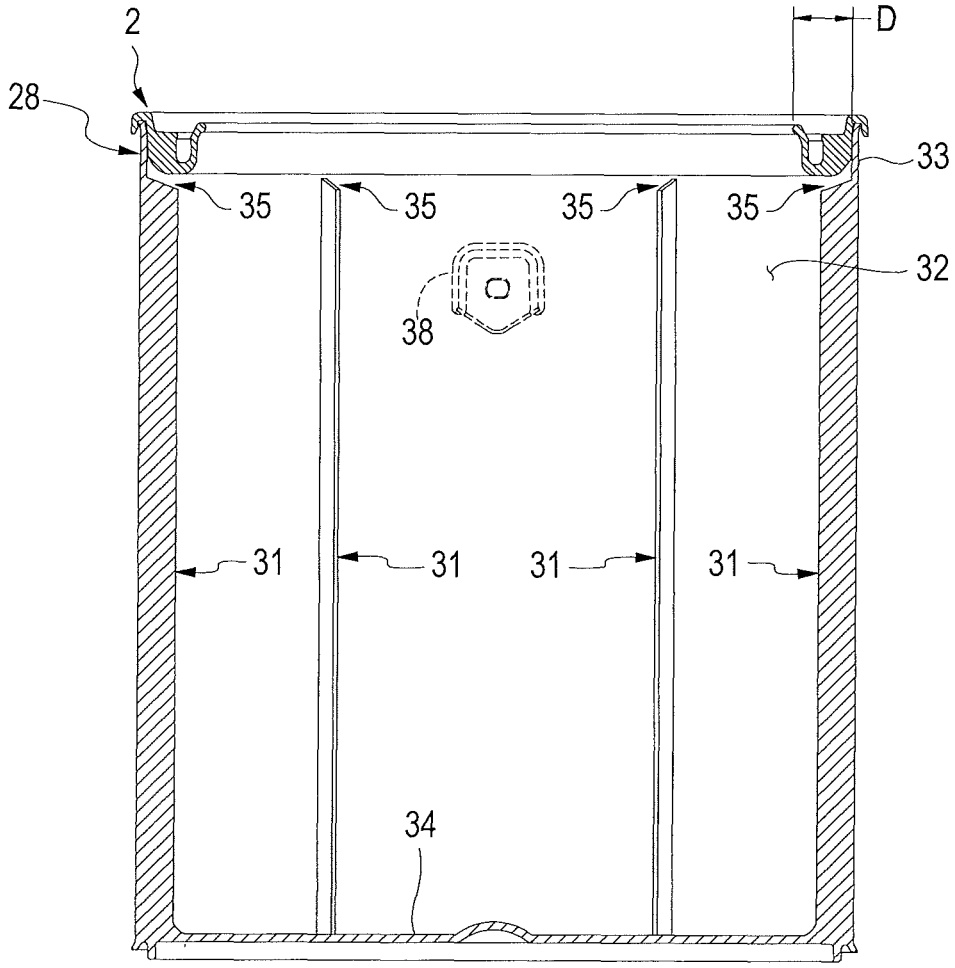
FIG. 6 is a section view of the container with the rim attached, depicting a radial mixing rib having a height from the interior wall which is less than the distance of the inner rim border from the interior wall.

FIG. 6 is a section view of the container with the rim 2 attached, showing that the mixing ribs 31 do not extend toward the center of the container beyond the opening defined by the inner rim border 16 of the rim 2. In this figure the height of the mixing ribs 31 from the interior wall 32 is less than the distance from the inner rim border 16 to the interior wall 32.

Figure 7:
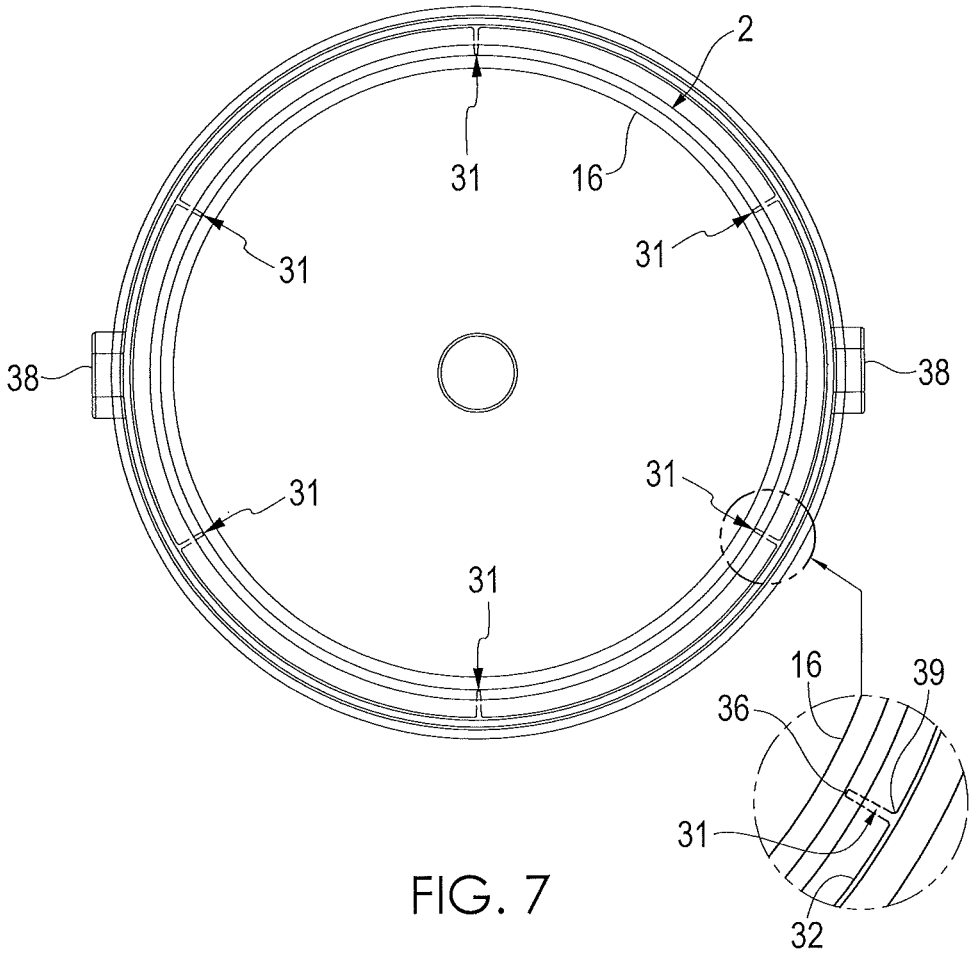
FIG. 7 is a top plan view of the container with the rim attached, showing the opening defined by the inner rim border, and also showing the position and distribution of radial mixing ribs which are not visible (except as shown by dotted lines).

FIG. 7 is a top plan view of the container with the rim 2 attached, showing the open end defined by the inner rim border 16, and also showing the position and distribution of the mixing ribs 31 which are not visible (except as shown only by dotted lines). In this figure the height of the mixing ribs 31 from the interior wall 32 is less than the distance between the inner rim border 16 and the interior wall 32. An inset shows greater detail of one of the mixing ribs with its tip 36 (shown by dotted lines) hidden by the rim 2.

Figure 8:
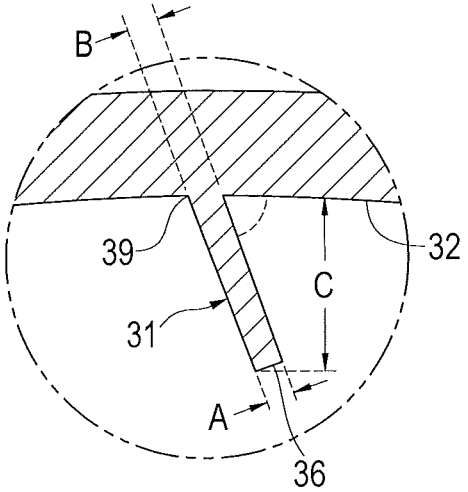
FIG. 8 is close up sectional view of a near-radial mixing rib which, except for the angle of the mixing rib, is otherwise similar to the inset in FIG. 3.

FIG. 8 is a close up sectional view of a near-radial mixing rib 31 with a dotted line arc to the interior wall 32 showing an angle of 70 degrees to a tangent line passing through a point in the sidewall at the center of the base 39 of a mixing rib. The angle for near-radial may vary within a range of at least 70 degrees to less than 90 degrees. Dimension A at the tip 36, dimension B at the base 39, and dimension C from the interior wall 32 to innermost point on the tip 36 (nearest the center of the container) are similar as described above relative to the inset in FIG. 3.

We claim:

1. A cylindrical plastic paint can comprising a. a circular sidewall having a top with an open end and being at 90 degrees to a bottom with a closed end, said sidewall being entirely vertical from the top to the bottom and having an interior wall, a center having a longitudinal axis and a lid, b. affixed to the open end, the rim having an inner rim border having a distance from the interior wall, c. a plurality of mixing ribs integral to the interior wall and the bottom, each of said mixing ribs having a vertical axis, a tip and a height from a base at the interior wall to the tip not exceeding the distance of the inner rim border from the interior wall, such that when the lid is joined to the rim and the paint can holding paint is spun or agitated in a paint mixing machine, the paint mixes thoroughly.

2. The paint can as in claim 1, wherein the vertical axis of each of the mixing ribs is perpendicular to a tangent passing through a point on the sidewall.

3. The paint can as in claim 1, wherein the vertical axis of each of the mixing ribs is at an angle of at least 70 degrees but less than 90 degrees to a tangent passing through a point on the sidewall.

4. The paint can as in claim 1, wherein the vertical axis of each mixing rib is perpendicular to the bottom.

5. The paint can as in claim 1, wherein each of the tips of the mixing ribs has a set of innermost points which form a vertical line parallel to the longitudinal axis in the center of the paint can.

6. The paint can as in claim 1, wherein the plurality of mixing ribs are six in number.

7. The paint can as in claim 1, wherein the plurality of mixing ribs are a number within a range of five to eight inclusive.

8. The paint can as in claim 1, wherein the distance of the inner rim border from the interior wall is within a range of 0.300 to 0.500 inches inclusive.

9. The paint can as in claim 1, wherein the distance of the inner rim border from the interior wall is approximately 0.400 inches.

10. The paint can as in claim 1, wherein the height from the interior wall to the tips is within a range of 0.200 to 0.300 inches inclusive.

11. The paint can as in claim 1, wherein the height from the interior wall to the tips is approximately 0.250 inches.

12. The paint can as in claim 1, wherein each of the mixing ribs has a first side and a second side, and has a thickness from the first side to the second side.

13. The paint can as in claim 12, wherein the thickness of the mixing ribs at the tip is within a range of 0.020 to 0.030 inches inclusive.

14. The paint can as in claim 12, wherein the thickness of the mixing ribs at the tip is approximately 0.025 inches.

15. The paint can as in claim 12, wherein the thickness of the mixing ribs declines from the base to the tip.

16. The paint can as in claim 1, wherein the tip of each of the mixing ribs and the rim define a space between them.

17. The paint can as in claim 16, wherein the space is within a range of 0.450-0.550 inches inclusive.

18. The paint can as in claim 16, wherein the space is approximately 0.500 inches.

19. The paint can is in claim 12, wherein the thickness of the mixing ribs near the base is within a range of 0.035-0.055 inches.

20. The paint can is in claim 12, wherein the thickness of the mixing ribs near the base is approximately 0.045 inches.

21. The paint can is in claim 1, wherein each of the mixing ribs comprises a mixing rib top, and the mixing rib tops and the rim define a small space between them.

* * * * *